US006159046A

United States Patent [19]

Wong

[11] Patent Number: 6,159,046

[45] Date of Patent: Dec. 12, 2000

[54] END CONNECTOR AND GUIDE TUBE FOR A COAXIAL CABLE

[76] Inventor: Shen-Chia Wong, No.10 Lane. 121, Li - Der Road., Peito District, Taipei, Taiwan

[21] Appl. No.: 09/351,625

[22] Filed: Jul. 12, 1999

[51] Int. Cl.[7] ..... H01R 9/05

[52] U.S. Cl. ..... 439/578; 439/583

[58] Field of Search ..... 439/578, 583, 439/584

[56] References Cited

U.S. PATENT DOCUMENTS

| | | | |
|---|---|---|---|
| 3,847,463 | 11/1974 | Hayward et al. | 439/578 |
| 5,597,322 | 1/1997 | Inaba et al. | 439/578 |
| 5,704,809 | 1/1998 | Davis | 439/578 |
| 5,769,662 | 6/1998 | Stabile et al. | 439/578 |
| 6,019,635 | 2/2000 | Nelson | 439/583 |

*Primary Examiner*—Khiem Nguyen
*Assistant Examiner*—Hae Moon Hyeon
*Attorney, Agent, or Firm*—Dougherty & Troxell

[57] ABSTRACT

A guide tube utilized as an assisting component when coupling an end connector to a coaxial cable. Having a passage formed through its body, the guide tube is inserted into the tubular body of the connector. As such, when installation personnel insert coaxial cable into the connector, the center conductor of the coaxial cable contacts a conical-shaped section inside the guide tube and, at the same time, the guide tube is moved forward. Due to the design of the conical-shaped section of the guide tube, the center conductor of the coaxial cable is guided into the connector in a perfectly straight state.

1 Claim, 9 Drawing Sheets

END CONNECTOR AND GUIDE TUBE FOR A COAXIAL CABLE

BACKGROUND OF THE INVENTION (1) Field of the Invention

The invention herein relates to a guide tube that is utilized as an assisting component when coupling an end connector to a coaxial cable in that the guide tube is capable of guiding the slanted center conductor of a coaxial cable into a perfectly straight state as the coaxial cable is inserted into the end connector.

(2) Description of the Prior Art

In cable television systems (CATV), subscription television systems (STV), and master antenna television systems, terminal, and other systems, the signals are transmitted by means of coaxial cable. Referring to FIG. 9, the conventional coaxial cable connector of such systems is comprised of the coaxial cable 10 itself and an end connector 11 (for example, an F-type, BNC, or RCA connectors); the installation personnel must effectively insert the cable 10 into the end connector 11 such that the center conductor 12 and the dielectric 13 are inserted through the inside of the tubular body 14 of the end connector 11, while the braided conductor 15 and the outer jacket 16 are sleeved around the extended rear section 17 of the tubular body 14 and, finally, a ring 18 is crimped over the coaxial cable 10 to bind it firmly to the extended rear section 17; however, since the inner diameter of the said tubular body 14 is slightly larger than the outer diameter of the dielectric 13, the installation personnel have an extremely difficult time inserting the dielectric 13 into the hollow body 14; furthermore, if the coaxial cable 10 is in a slanted state, the installation personnel experience further difficulty while inserting the dielectric 13 through the tubular body 14, which poses tremendous installation problems; as such, the industry is currently awaiting a solution to the said shortcomings to increase competitiveness.

In view of the said situation, the inventor of the inventor herein conducted intensive research based on many years of experience accumulated while engaged in the production and marketing of related products which, following continuous testing and refinements, finally culminated in the development the guide tube of invention herein.

SUMMARY OF THE INVENTION

The primary objective of the invention herein is to provide a guide tube, wherein the center conductor of coaxial cable is inserted into the guide tube and, at the same time, the guide tube is moved into position, thereby enabling the easy insertion of the center conductor and the dielectric into an end connector.

Another objective of the invention herein is to provide a guide tube, wherein if the coaxial cable is inserted into the guide tube in a slanted state, the said center conductor is corrected by a conical-shaped section, thereby guiding the coaxial cable into a perfectly straight line.

To enable a further understanding of the said objectives, innovations, technological means involved, and other functions of the invention herein, the brief description of the views below is followed by the detailed description of the preferred embodiments.

BRIEF DESCRIPTION OF THE VIEWS

Figure 4A:
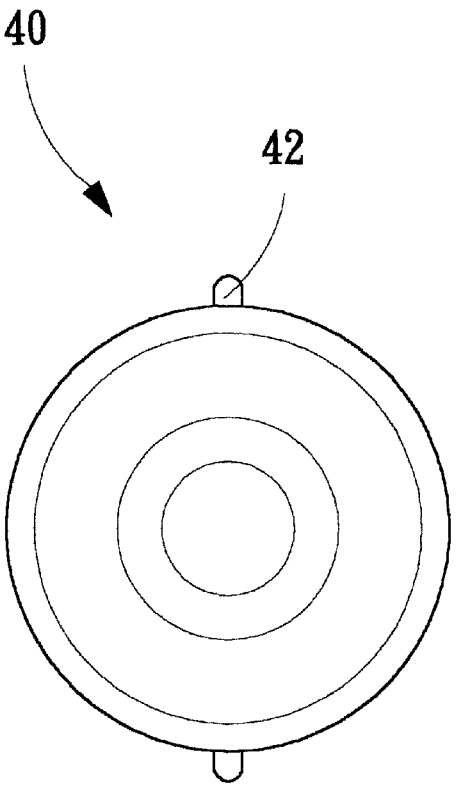
FIG. 4 is a cross-sectional view of second Embodiment of the present invention.

FIG. 4*a* is a side elevational view of the second embodiment of the invention.

Figure 5:
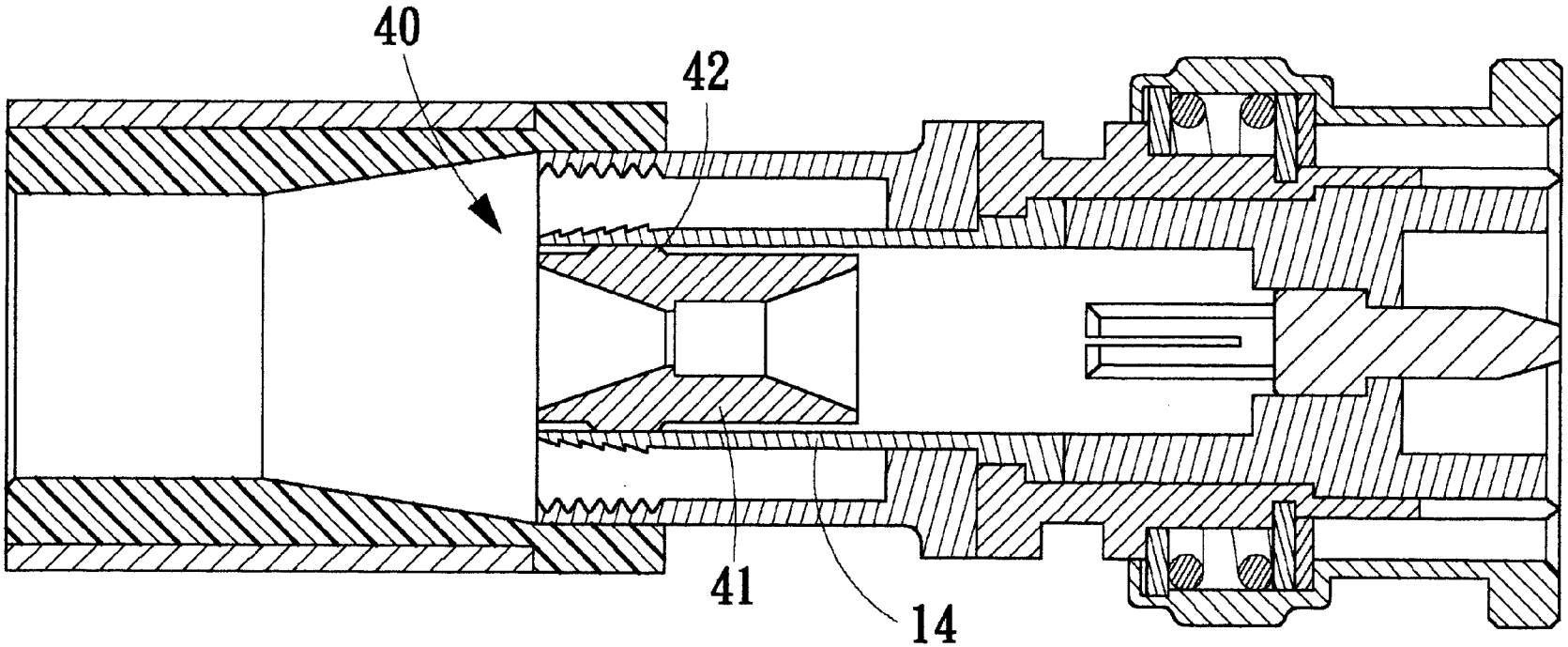

FIG. 5 is a cross-sectional view of the present invention installed to an F-type connector.

Figure 6A:
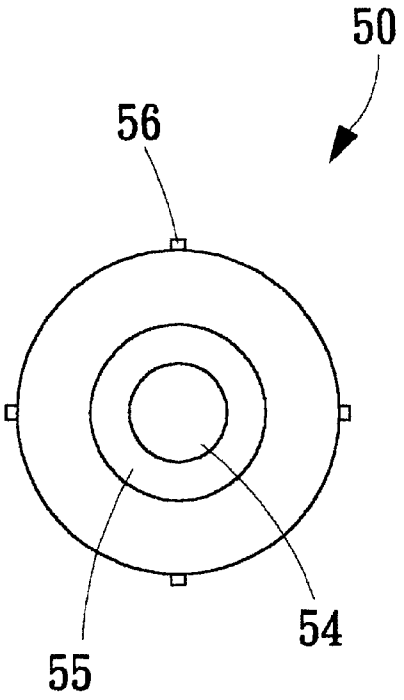
Figure 6:
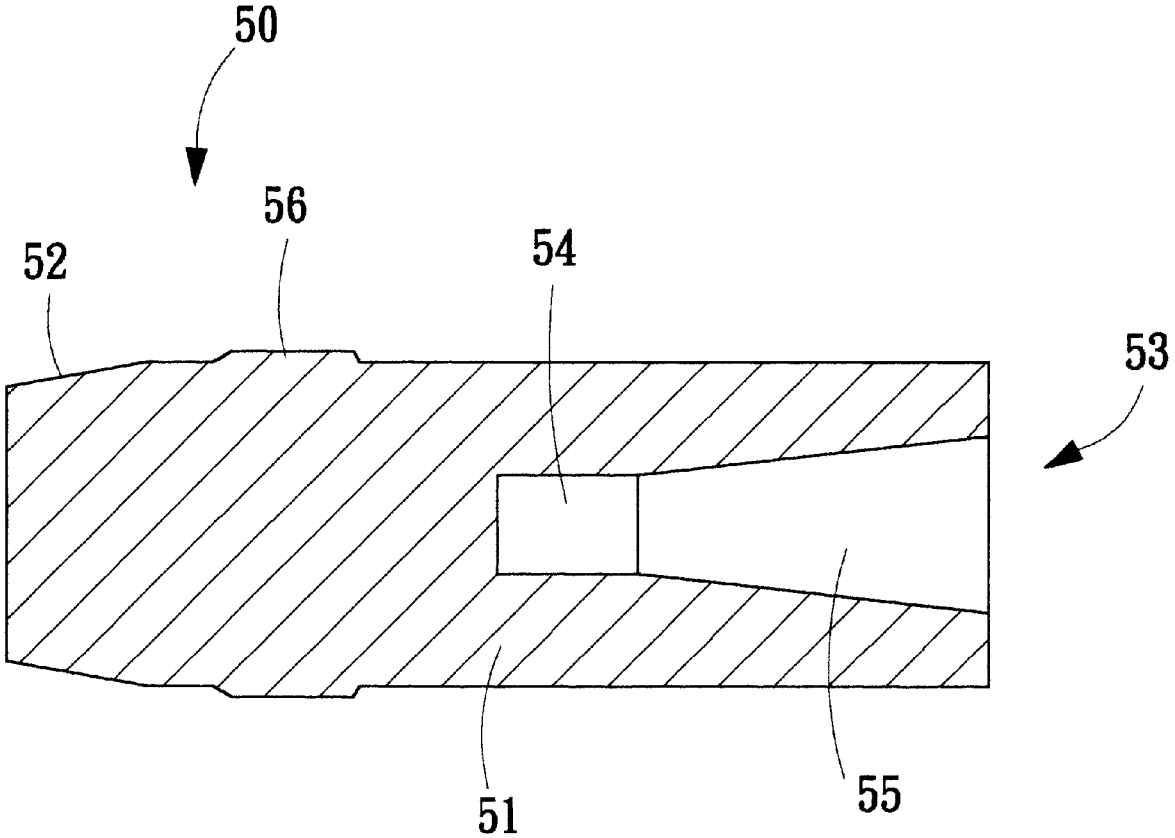

FIG. 6 is a cross-sectional view of the third Embodiment of the present invention.

FIG. 6A is the right side orthographic view of FIG. 6.

Figure 7:
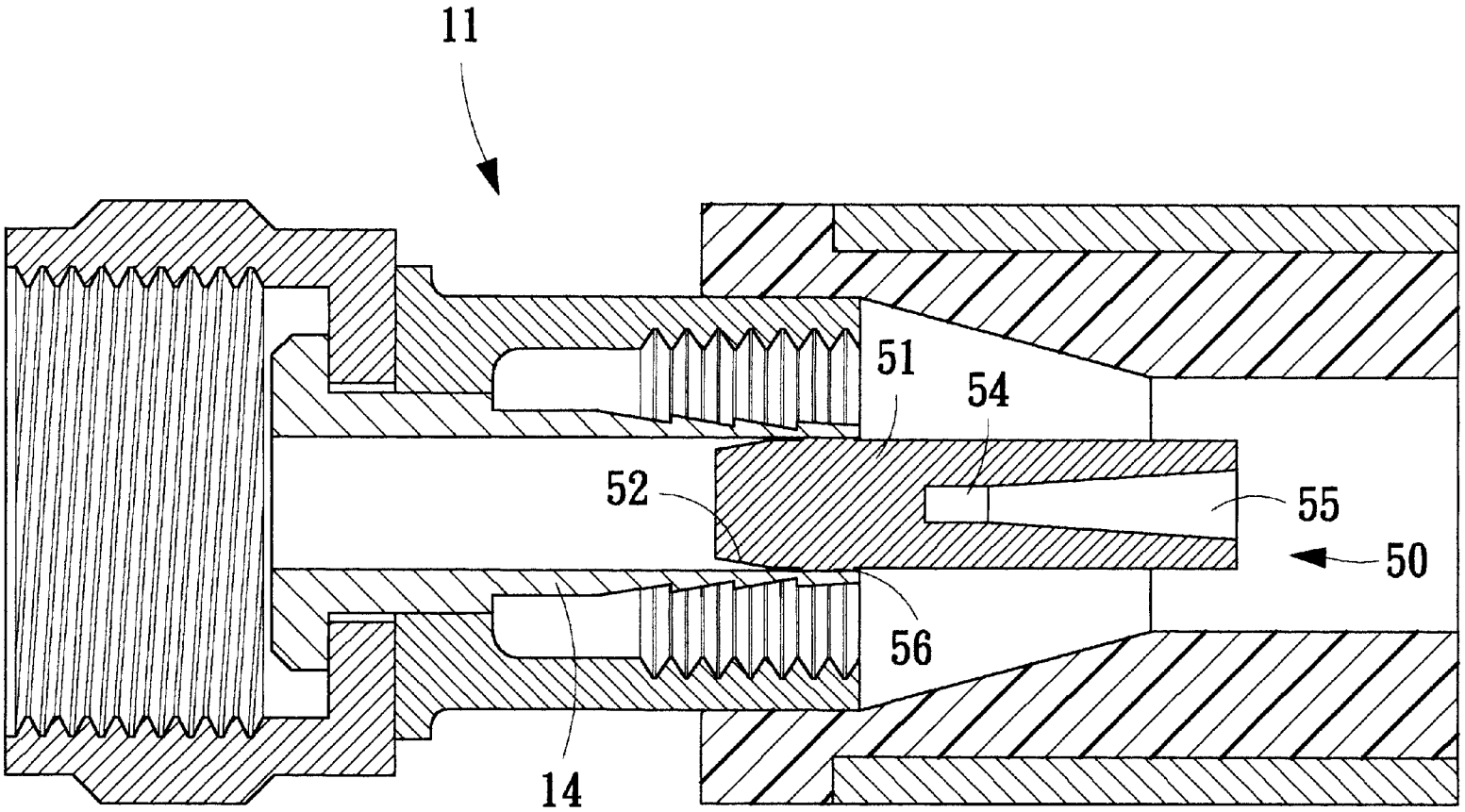

FIG. 7 is a cross-sectional view of the guide tube depicted in FIG. 6 as installed to an F-type connector.

Figure 8:
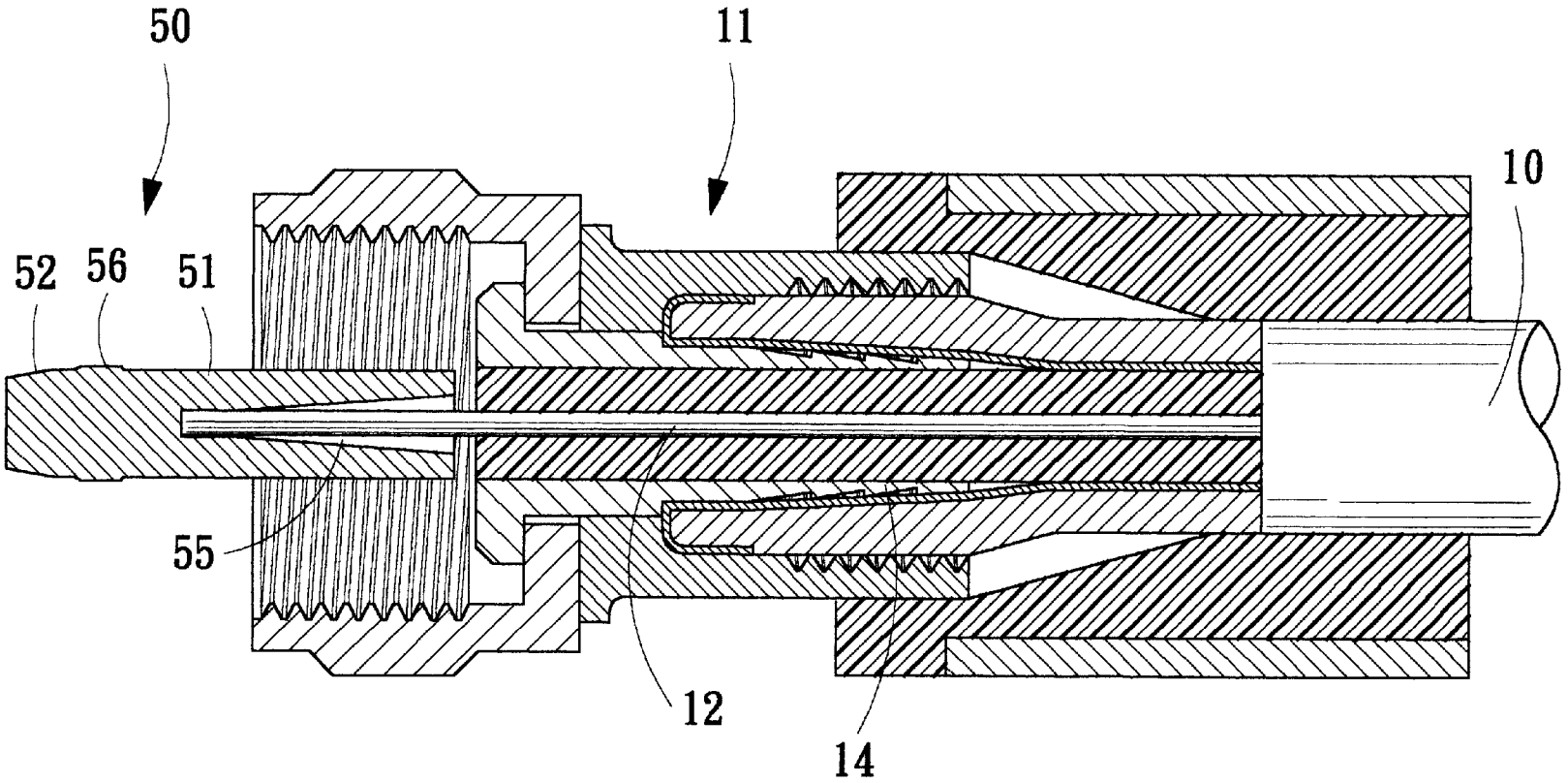

FIG. 8 is a cross-sectional view of FIG. 6 after insertion onto a coaxial cable.

Figure 9:
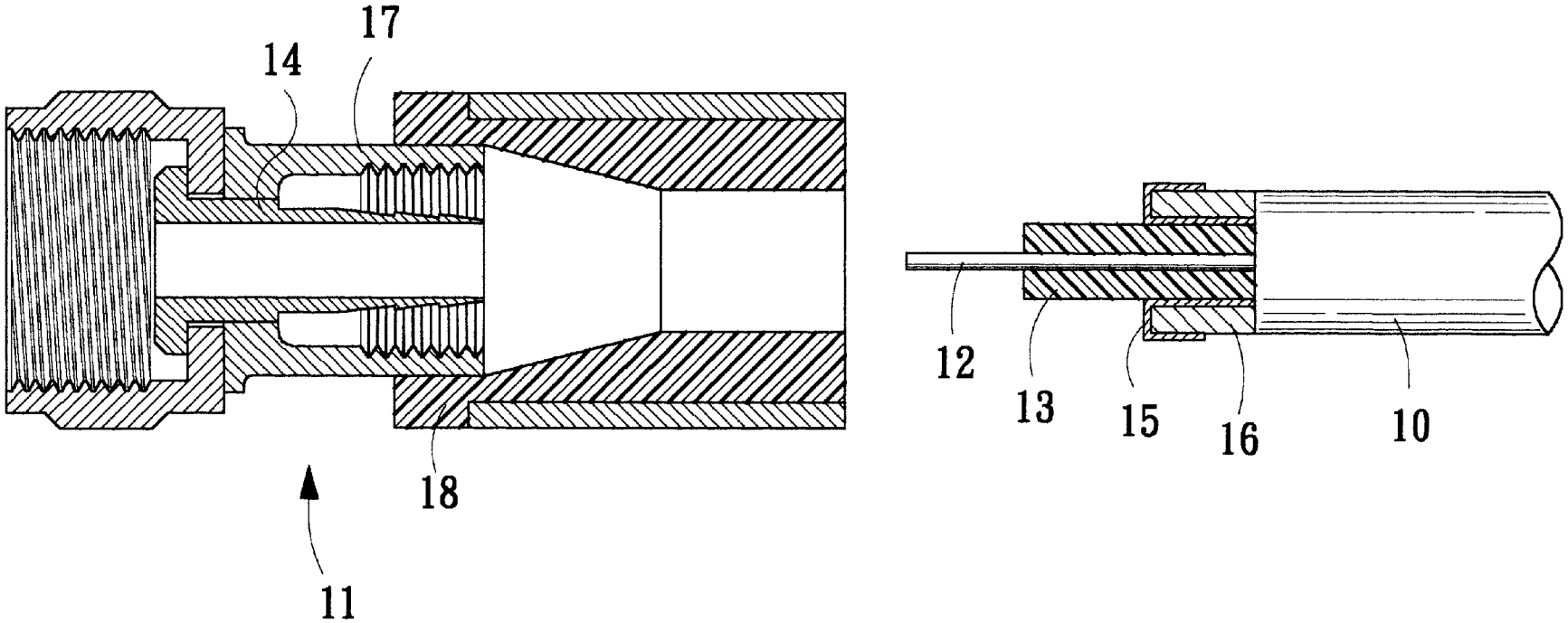
FIG. 9 PRIOR ART

FIG. 9 is a cross-sectional view of a conventional coaxial cable and connector in a unassembled state.

DETAILED DESCRIPTION OF THE PREFERRED EMBODIMENT

Referring to FIG. 1, FIG. 1A, FIG. 2, and FIG. 3, the guide tube 30 of the first Embodiment is comprised of a hollow body 31 constructed of a plastic material, and formed throlgh the said body 31 is a passage 32 consisting of conical-shaped section 321, an insert section 322, and a guide section 323; the said conical-shaped section 321 is profiled such there is a gradually reduction in its diameter from the outside to the inside, the innermost edge then merging with a larger diameter insert section 322 and the rear edge of the insert section 322 finally merges with the guide section 323 which gradually increases in diameter from the inside to the outside; furthermore, there are one or more nibs 33 formed on the outer extent of the end section of the body 31, with an angled surface contact area formed at the intersection of the said nibs 33 and body 31.

Figure 1A:
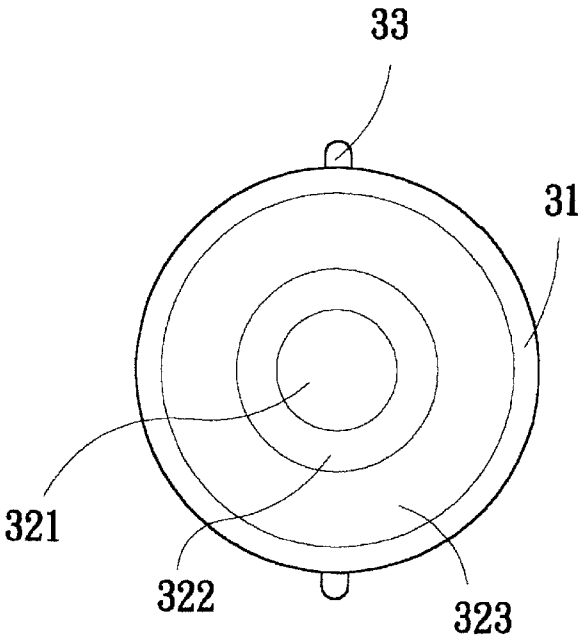
FIG. 1A is the right side elevational view of FIG. 1.
Figure 1:
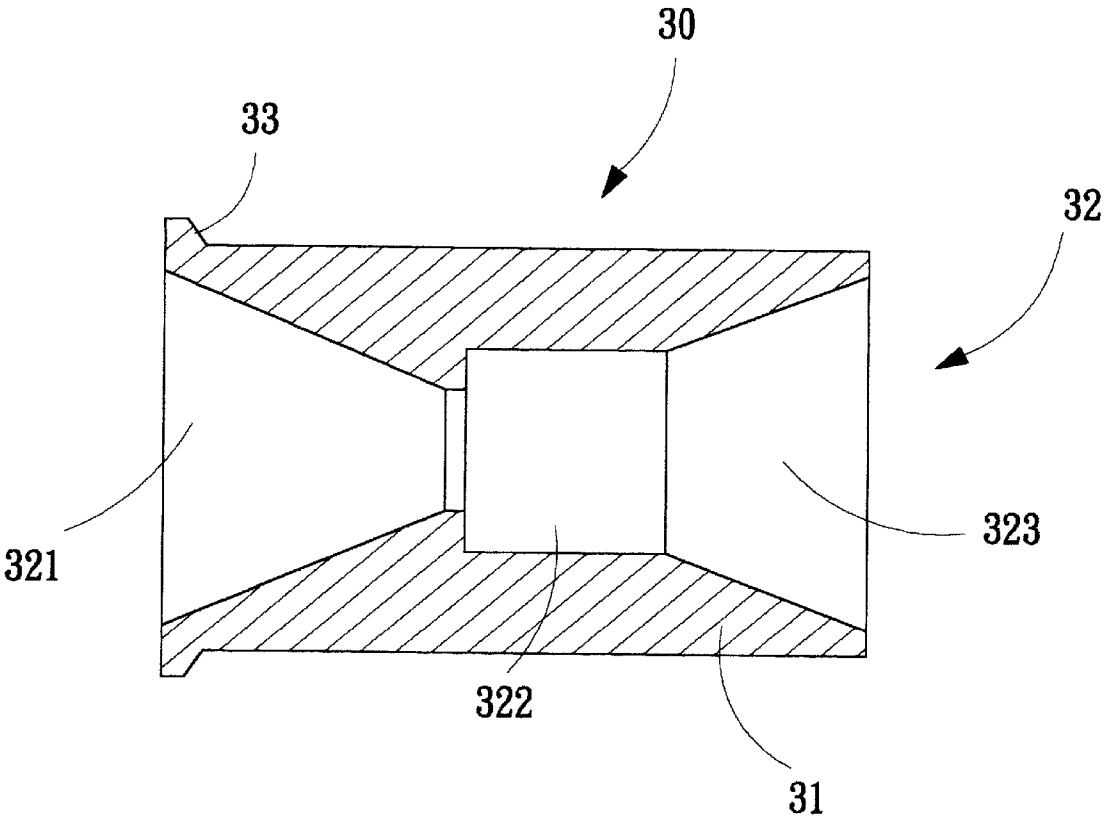
FIG. 1 is a cross-sectional view of the first Embodiment of the present invention.
Figure 2:
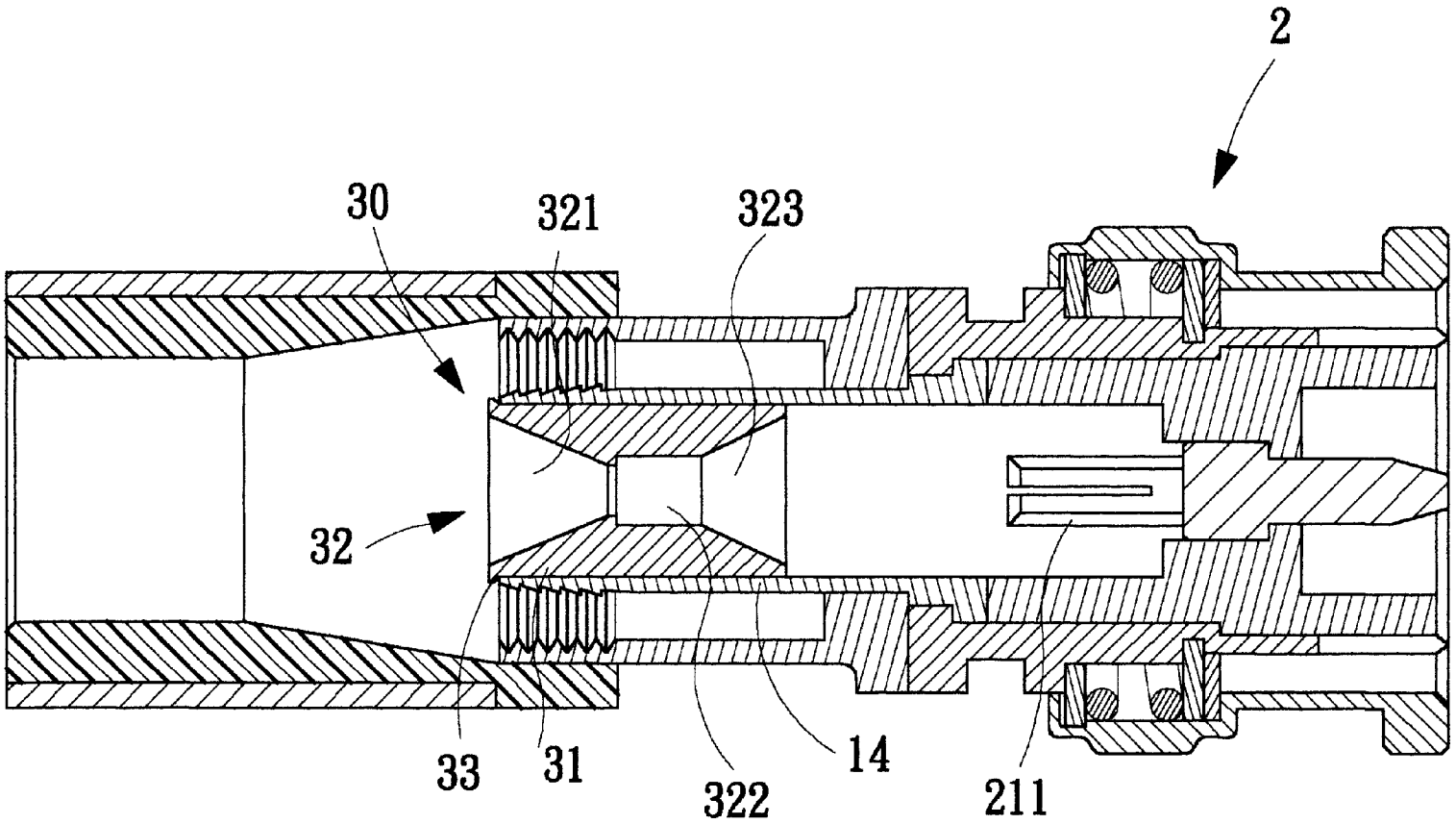
FIG. 2 is a cross-sectional view of the present invention installed to a BNC connector.
Figure 3:
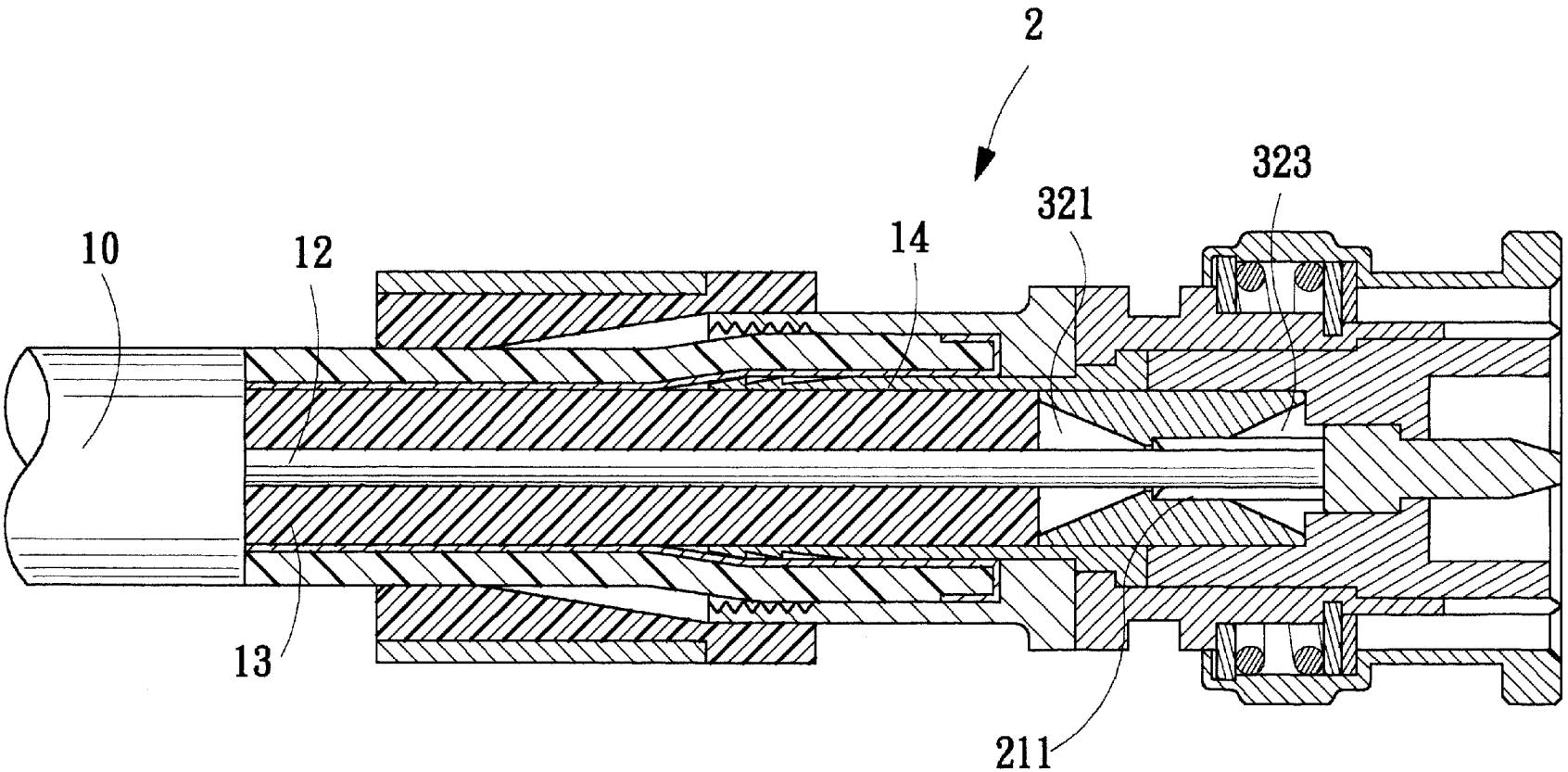
FIG. 3 is a cross-sectional view of FIG. 2 after insertion onto a coaxial cable.

Referring to FIG. 2 and FIG. 3, as the guide tube 30 of the first Embodiment is installed to the tubular body 14 of a BNC connector 2, the nibs 33 are positioned in the tubular body 14 and when the center conductor 12 and the dielectric 13 of the coaxial cable 10 are inserted into the BNC connector 2, the dielectric 13 is squeezed forward by the guide tube 30 of the first Embodiment, causing the nibs 33 to become cut off by the metal tubular body 14 or directly inserted into the tubular body 14, the insertion of the center conductor 12 into the insert section 322, and the dielectric 13 to be squeezed forward in the guide tube 30 of the first Embodiment , and the contact sleeve 211 to enter into the insert section 322, thereby enabling the center conductor 12 to become inserted easily into the contact sleeve 211.

When the coaxial cable 10 is inserted into the BNC connector 2 at an angle, the center conductor 12 of the said coaxial cable 10 contacts the conical-shaped section 321 inside the guide tube 30, causing the center conductor 12 of the coaxial cable 10 to push the guide tube 30 forward and, since the conical-shaped section 321 of the guide tube 30 is profiled such there is a gradual reduction in diameter from the outside to the inside, the center conductor 12 of the coaxial cable 10 is gradually guided towards the center of the tubular body 14 and, since the insert section 322 of the guide tube 30 is ensleeved around the outer diameter of the contact sleeve 211, the center conductor 12 is accurately inserted into the contact sleeve 211.

Figure 4:
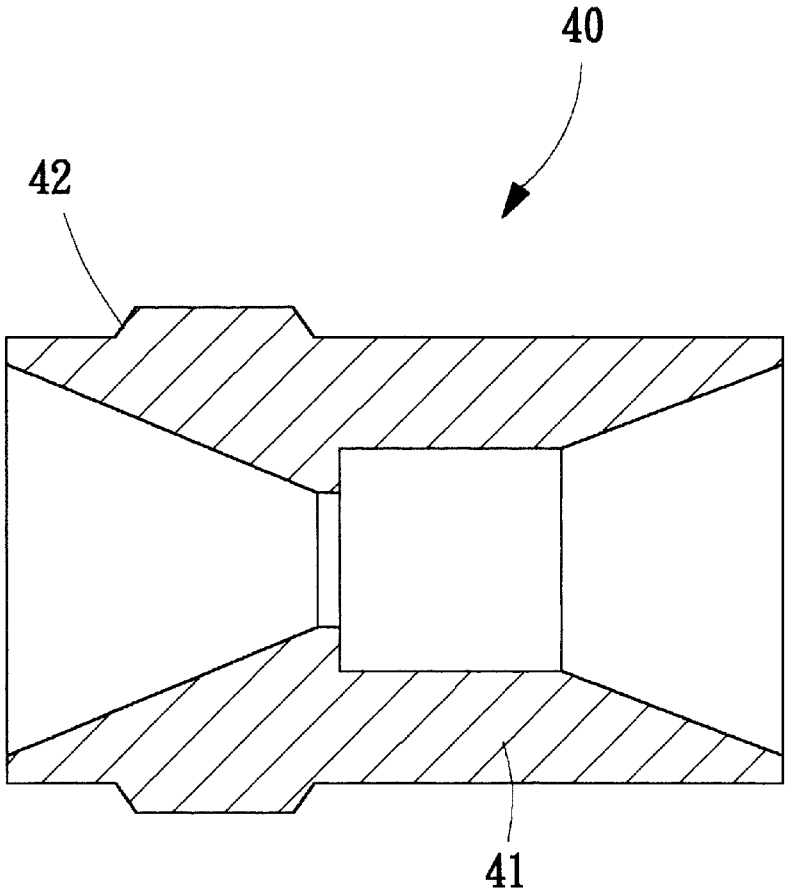

Referring to FIG. 4 and FIG. 5, the guide tube 40 of the second Embodiment of the present invention is generally similar to the guide tube 30 (the first Embodiment), with the difference in the design being the position of the nibs 42; the said nibs 42 are positioned at an appropriate area on the outer extent of the body 41, enabling the contact friction so produced between it and the tubular body 14 to prevent dislodgment.

Referring to FIG. 6, FIG. 6A, FIG. 7, and FIG. 8, the guide tube 50 of the third Embodiment of the Present invention as installed on the tubular body 14 of an F-type connector 11, the said guide tube 50 is comprised of a body 51 having a beveled surface 52 formed at one end that enables easy insertion into tubular body 14 and a passage 53 recessed at the other end, with the said passage 53 composed of an insert section 54 and a conical-shaped section 55; furthermore, one or more nibs 56 are formed at an appropriate area on the outer extent of the body 51, enabling the contact friction so produced between it and the tubular body 14 to prevent dislodgment; in addition, the angled surface contact area formed by the intersection of the said nibs 56 and body 51 enable the smooth insertion of the guide tube 50 into the tubular body 14 along the said angled surface.

When the coaxial cable 10 is inserted into the F-type connector 11 in a perfectly straight state, the said center conductor 12 is directly inserted into the insert section 54, while guide tube 50 of the third Embodiment is pushed forward and, furthermore, pushed through the F-type connector 11 to thereby permit the easy completion of the assembly task.

When the coaxial cable 10 is inserted into the F-type connector 11 at an angle or in an uncentered state, the said center conductor 12 contacts the conical-shaped section 55, which corrects the angle of and guides the center conductor 12 into the insert section 54 and pushes it through the F-type connector 11, thereby permitting the easy completion of the assembly task.

However, the views and description disclosed in the foregoing section only relate to the preferred embodiments of the invention herein and shall not be construed as a limitation upon other embodiments of the present invention. Furthermore, all modifications and embellishments whatsoever based on the said disclosure and attempted by persons skilled in the technology shall remain within the scope and claims of the invention herein.

What is claimed is:

1. An end connector and guide tube for guiding a coaxial cable into the end connector comprising:

an end connector including a longitudinally extending passageway;

a guide tube having a body with an outer extent, a conical-shaped section, a guide section and an insert section formed on an inside part of said body, said guide section and said conical-shaped section each having a rear extent merging into said insert section and wherein said conical-shaped section and said guide section are profiled so that there are gradual reductions in their diameters from the outside to the inside, said body including a nib formed on said outer extent with an angled surface contact area formed at the intersection of said nib and said outer extent of said body for enabling a smooth insertion of said guide tube into said longitudinally extending passageway and said body and said nib sized so that said body fits within said longitudinally extending passageway with contact friction for movement along said passageway;

said guide tube being installed into said connector with a coaxial cable including a center conductor inserted into said connector so that the center conductor of the coaxial cable is guided and positioned by said conical-shaped section and said insert section as said guide tube is moved forwardly along said passageway thereby enabling the center conductor of the coaxial cable to be inserted in said connector.

* * * * *